United States Patent [19]

West

[11] 4,238,105

[45] Dec. 9, 1980

[54] MOLD PANEL FOR CASTING CONCRETE

[75] Inventor: Gardner D. West, Woody Creek, Colo.

[73] Assignee: Therma Form, Inc., Hubbard, Tex.

[21] Appl. No.: 5,660

[22] Filed: Jan. 22, 1979

[51] Int. Cl.[3] ..... B22D 27/02

[52] U.S. Cl. ..... 249/78; 249/79; 249/80; 249/189; 249/200; 264/DIG. 46

[58] Field of Search ..... 249/34, 35, 78, 79, 249/80, 189, 200, 191, 192; 264/DIG. 46

[56] References Cited

U.S. PATENT DOCUMENTS

| | | | |
|---|---|---|---|
| 2,500,866 | 3/1950 | Ramsay | 264/DIG. 46 |
| 2,602,210 | 7/1952 | Rumble | 249/79 |
| 2,707,802 | 5/1955 | Gard | 249/78 |
| 3,659,077 | 4/1972 | Olson | 249/78 |
| 3,729,614 | 4/1973 | Martinet | 249/78 |

*Primary Examiner*—Donald J. Arnold
*Attorney, Agent, or Firm*—Robert T. Dunn

[57] ABSTRACT

A heated mold panel for casting concrete has a rigid base providing a base surface, a substantial part of which is grooved by interconnecting grooves, has a continuous heating element laid in the grooves, and the base surface is covered with a non-porous, non-corrosive material that provides a smooth outside surface covering the base surface, spanning the grooves and enclosing the element in interconnecting passages defined by the grooves and the covering material. Sufficient clearance is provided in said passages around the element for air to flow freely from passage to passage, whereby heat flow from the element to the concrete poured against the outside surface is by radiation from the element and by convection of air flowing in the passages around the element.

14 Claims, 8 Drawing Figures

MOLD PANEL FOR CASTING CONCRETE

BACKGROUND OF THE INVENTION

The present invention relates to apparatus for moulding building materials and, particularly, for moulding concrete where the curing of the concrete is accelerated by the application of heat.

Heretofore, heated molds or form panels for containing and curing poured concrete have been provided by large hollow panels. The panels must provide a large surface area against which the concrete is poured so that the number of such panels required to define the mold for the concrete is not excessive. The larger size of these panels alone dictate that they must be bulky and heavy. Furthermore, in the past, where the panels are heated so that heat is delivered to the wet concrete accelerating the curing process, the panels have been hollow to provide space inside the panel for tubing and other conduits that carry steam pipes. For example, one panel of this type provides a shell and a web or cover on top of the shell, the outside of web being the surface against which the concrete is poured and the shell defining the passages that contain the steam pipes. These panels require external reenforcement to maintain the shell rigid and so the complete structure including the reinforcing is sometimes found to be excessively bulky and heavy which, of course, adds to the difficulties of erecting the panels to provide a form for the concrete and then later tearing down the panels to use them again after the concrete has cured. To these difficulties are added the necessary time and effort to connect steam sources to the individual panels and, then disconnect when the panels are taken down.

It is the principal object of the present invention to provide a modular type heated mold panel for concrete which provides a relatively large heated surface against which the concrete is poured, the panel having sufficient strength and rigidity to withstand the rigors of in situs use, but lighter in weight and less bulky then heated panels of the same size used in the past.

SUMMARY OF THE INVENTION

It is a principal feature of the present invention to provide a heated mold panel for casting concrete including a panel base that may be a solid sheet of relatively rigid material providing the necessary rigidity and strength that such a panel requires and substantially defining the panel in size and shape. A plurality of connecting grooves are provided in one surface of the base, called the base surface, and heating elements are located in the grooves, the grooves being sufficiently deep that the heating elements do not extend across the plane of the base surface and yet, the grooves do not substantially decrease the strength or rigidity of the base. At least one layer of non-corrosive, non-porous material covers the base surface and the heating elements in the grooves, spanning the grooves, provides a smooth outside surface generally parallel to the base surface, the layer of material being generally contiguous with the base surface so that except where the grooves are located, the covering material is entirely supported by the base surface; and means are provided for connecting the elements to a source of energy.

In a preferred embodiments, a single continuous electric heating element is provided in the grooves and so the grooves interconnect and the space around the elements defined by the grooves and the layer of covering material provides sufficient clearance around the electric element so that air flows freely through that space around the element. Heat flow from the element to the concrete against the outside surface of the panel is by radiation and by convection of the air flow around the element.

Other objects of the invention are the following:

To provide an improved heated panel for containing a material;

To provide an improved heated panel for molding and accelerating the curing of concrete;

To provide such a panel that is relatively thin and relatively light in weight, but having sufficient rigidity and strength for in situs use;

To provide such a panel in which heat is provided electrically and is controlled automatically to maintain the surface of the panel against the concrete at an even heating temperature while the concrete cures; and To provide such a panel with means for indicating when said panel has reached said temperature or is being heated;

These and other objects, features and advantages of the present invention will be apparent from the following description of embodiments of the invention as described herein below with reference to the accompanying drawings.

DESCRIPTION OF EMBODIMENTS OF THE INVENTION

Figure 1:
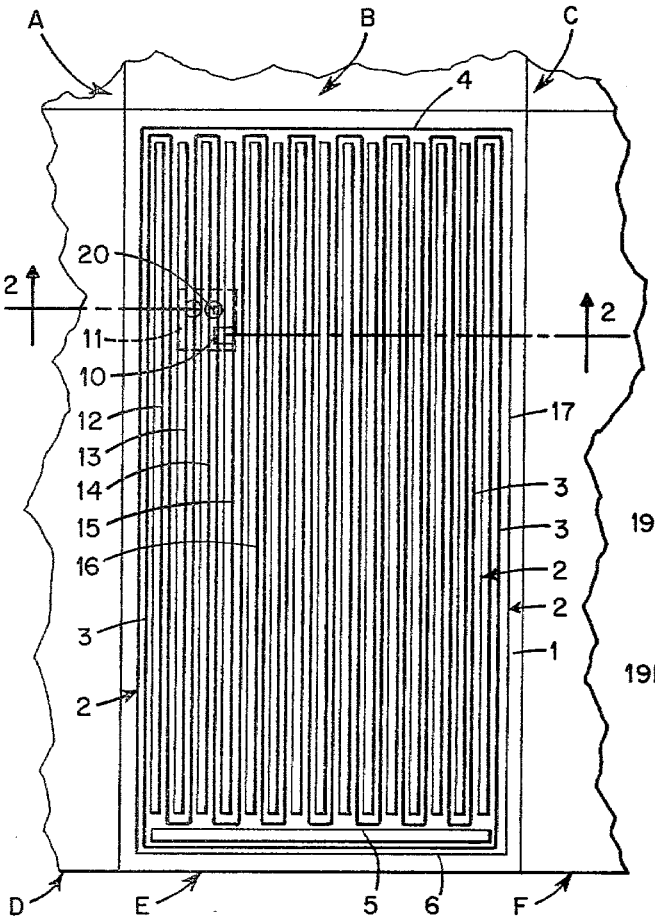
FIG. 1 is a view from the concrete side of a group of panels abutting, with covering removed from a panel, showing the grooves, the electric heating element laid in the grooves and the location of electrical parts.

Several abutting panels A, B, C, D, E and F are shown in FIGURE I as viewed from the concrete side, also called the mold side. Panel E is shown with the mold side cover layer removed to reveal the arrangement of grooves containing the heating element. The surface of each of the panels shown in FIGURE I may be rectangular or square and measure several feet in each direction. Typical panel dimensions are four feet by eight feet.

The panels, such as panel E, are quite rigid and have sufficient strength to remain rigid abutting each other under the pressure of poured concrete, and also withstand the rigors and abuse of in situs use without requiring external reinforcing structures. For example, the panel base may be heavy plywood, at least an inch thick for the four foot by eight foot size. In this embodiment, the base I is grooved by interconnecting grooves that define a pattern having the appearance of a ladder. The grooves 2 define a space for containing the heating element 3 which is continuous from a beginning point 10 to and ending point 20, these two points being in relatively close proximity to each other. Control apparatus 11 for the heating element is provided at the vicinity of the two points 10 and 20 and includes a temperature sensitive switch or valve for controlling the flow of energy to the heating element from an external source of energy. Also located at the control area 11 may be another temperature sensitive switch for turning on an indicator to indicate when the element is hot.

Since the element is preferably continuous from its beginning to its end, and preferably distributes heat evenly over a substantial area of the panel, it is convenient that the element be laid down on a serpentine or zig-zag path as shown in FIGURE 1. For this purpose, the grooves on this embodiment define a ladder shape providing top and bottom horizontal grooves 4 and 5 that extend substantially the width of the panel close to the short edges and parallel to each other and a multitude of vertical grooves such as 12, 13, 14, 15 and 16 all parallel to each other and connecting groove 4 to groove 5.

The heating element 3 is laid in the groove beginning at point 10 located in groove 14 and extending up and down in the vertical grooves, across horizontal grooves 4 and 5, to the last vertical groove 17, at the right side. From groove 17 the element returns to the end point 20 across another horizontal groove 6 to the last vertical groove 18 at the left side and from 18 to 12, from 12 to 13, from 13 to 14, to the end point 20 in groove 14. Presuming the element to be relatively uniformly heated over its entire length, then it is apparent from the pattern shown in FIG. 1 that the element delivers heat relatively uniformly throughout substantially the entire surface of the panel.

Figure 4:
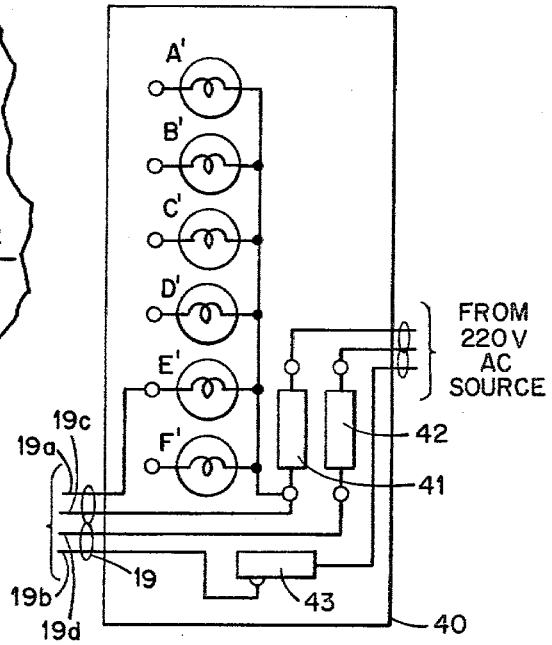
FIG. 4 illustrates a junction box feeding power to several panels.
Figure 2:
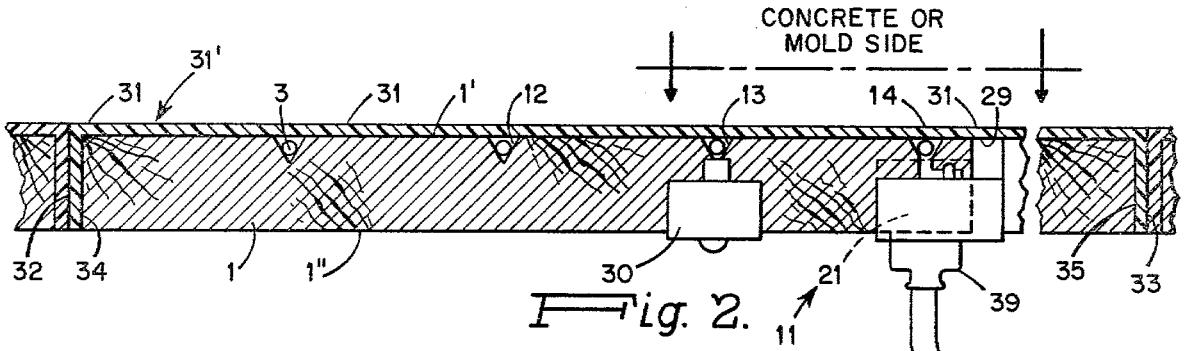
FIG. 2 is an enlarged cross-section view of abutting panels taken as shown in FIGURE I showing the location of the electrical parts, the grooves and the covering layer providing a smooth concrete side surface.
Figure 3:
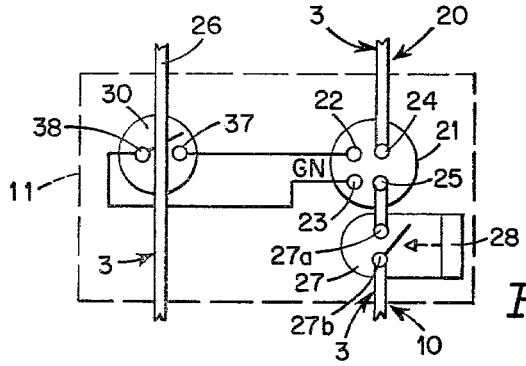
FIG. 3 is an another view of the electrical parts and connections of a panel taken as shown in FIG. 2.

In preferred embodiments of the present invention, the heating element 3 is an electrical heating element; more particularly, it is a resistance element and the resistance is uniform throughout the length or the element. Electric power to the element is 220 volts AC power connected at a four terminal electric receptacle 21 mounted in the panel at the control area 11, and electric power is delivered to this receptacle from a suitable power cable 19 from the junction box 40 illustrated in FIGURE 4. An enlarged view of the receptacle and other electrical components at the control area 11 are shown in FIGURES 2 and 3.

The electric power system may be a two, three or four wire system. The system shown here is essentially a three wire, 220 volt, AC system that has a ground wire and two "hot" wires, each at a different phase of 110 volts with respect to the ground. The cable from each panel to the junction box includes four wires, two hot wires each at different phases of 110 volts, a ground wire and a ground return wire that returns ground from the panel to an indicator light on the junction box.

On the panel, the receptacle 21 has four terminals. Terminal 23 is the ground, terminal 22 is the ground return, and the two terminals 24 and 25 are the "hot" terminals. Hence, there is 220 volts across terminals 24 and 35. The ends of the resistance heating element 3 connect across the hot terminals of the receptacle, the beginning 10 of the element connecting to terminal 25 and the end 20 connecting to terminal 24. With this arrangement, when electric power from the junction box is plugged into receptacle 21, the heating element is energized.

End 20 of the element connects directly to terminal 24 of the receptacle. However, between the beginning 10 of the element and terminal 25, immediately below the receptacle, in the control area 11, in electrical series with the element is high power temperature sensitive switch 27 that connects at its terminals **27*a* and 27*b* to the element. The temperature sensing part 28 of this switch is in intimate thermal contact at 29 with the covering 31 on the surface 1' of the base 1 and this switch is set so that it remains closed and the element continues to conduct electric power until the covering 31** reaches a predetermined temperature. Then, the switch cycles open and closed turning power on and off as necessary to maintain the covering at the predetermined temperature. The temperature of the covering is presumed to be substantially the temperature of the concrete immediately adjacent the form. Thus, heat flows from the form to the concrete while the interface of the form with the concrete is maintained at a substantially constant temperature throughout while the concrete cures.

In the control area 11 may be located one or more detectors for detecting when the heating element (or for that matter, any part of the panel) is hot or reaches the predetermined temperature, that delivers suitable heat flow to the concrete. For example, another temperature sensitive switch 30 abuts the heating element in groove 13 and closes when the element is hot (or at said predetermined temperature). The two terminals 37 and 38 of this switch connect to the terminals 22 and 23, respectively, of receptacle 21 and so 22 and 23 are shorted together where switch 30 closes.

The four wire power cable 19 connects to receptacle 21 by plug 39. This cable comes from the junction box 40, illustrated by FIGURE 4. The four wires **19*a*, 19*b*, 19*c* and 19*d* of this cable connect by plug 39 to the terminals 22, 23, 24 and 25** respectively.

At the junction box are 110 volt indicator lights A' to F' which indicate that the heating elements in panels A to F, respectively, are hot. Only wiring from junction box to cable 19 that feeds panel E is shown. Cables from the other panels are connected in the same way. The hot wires **19*c* and 19*d* connect to fuses 41 and 42 that connect across the two phases of a 220 volt, AC source. Ground wire 19*b* connects to the ground bus 43 in the junction box. The other wire 19*a*** connects to one side of indicator lamp E' and the other side of the lamp connects to one of the hot wires (at one of the fuses).

The electrical system described above, including the junction box, provides workmen a central junction for powering all panels in a group and they need only observe the indicator lights to see if all panels are hot. Then the panels draw electric power to remain hot as determined by the temperatures sensitive switch 27. For this operation the temperature sensitive switches 27 and 30 may close at different temperatures. For example, switch 30 may close at a relatively low temperature, about 90 to 150° F., and switch 27 may close at a substantially higher temperature.

One convenient arrangement of the electrical elements at the control area 11 is to align the plug 21 and the temperature sensitive switch 27 in line with the heating element in one groove, (groove 14), and temperature sensitive switch 30 is aligned with the adjacent channel 13. Furthermore, the elements may be protected by an enclosure that projects slightly from the back surface 1'' of the base and, as already mentioned, the lights A' to F' are located on the circuit breaker box 40 so they can be seen readily by workmen who erect the panels and pour the concrete.

Figure 5:
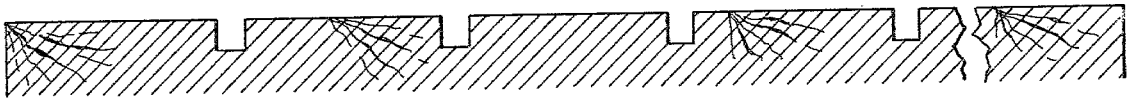
FIG. 5 through 7 show other groove configurations of suitable shape and relative size.
Figure 6:
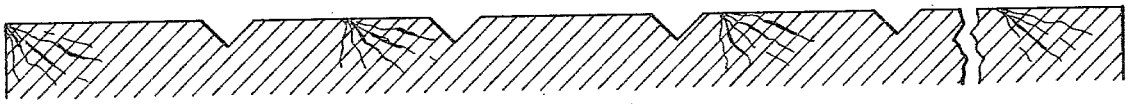
Figure 7:
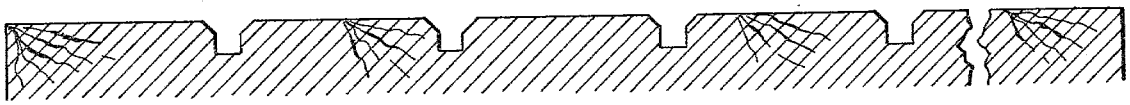

The grooves that contain the heating element may be simple V grooves as shown in FIGS. 2 and 6 or other shapes may be used. For example, they may be square cuts as shown by FIG. 5 or flared cuts as shown by FIG. 7. The purpose of the grooves is to hold the heating element so that it does not protrude above the surface 1' of the base and provide sufficient space around the heating element for convective air currents to flow carrying heat evenly throughout the grooves. At the same time, the grooves must not impair the regidity and strength of the base 1 so as to require reinforcing external structure, as that would defeat one of the important advantages of the invention. The cross-section area of the groove need not be more than a few times greater than the cross-section area of the heating element to allow sufficient space around the element for convective air current flow throughout the grooves. As already mentioned, heat flow from the element to the poured concrete is by radiation and by convection. Conductive heat flow from the element is substantially negligible and by far the greater portion of the heat flow is by radiation, hence, there need not be a large passage surrounding the heating element to carry convective air currents.

Figure 8:
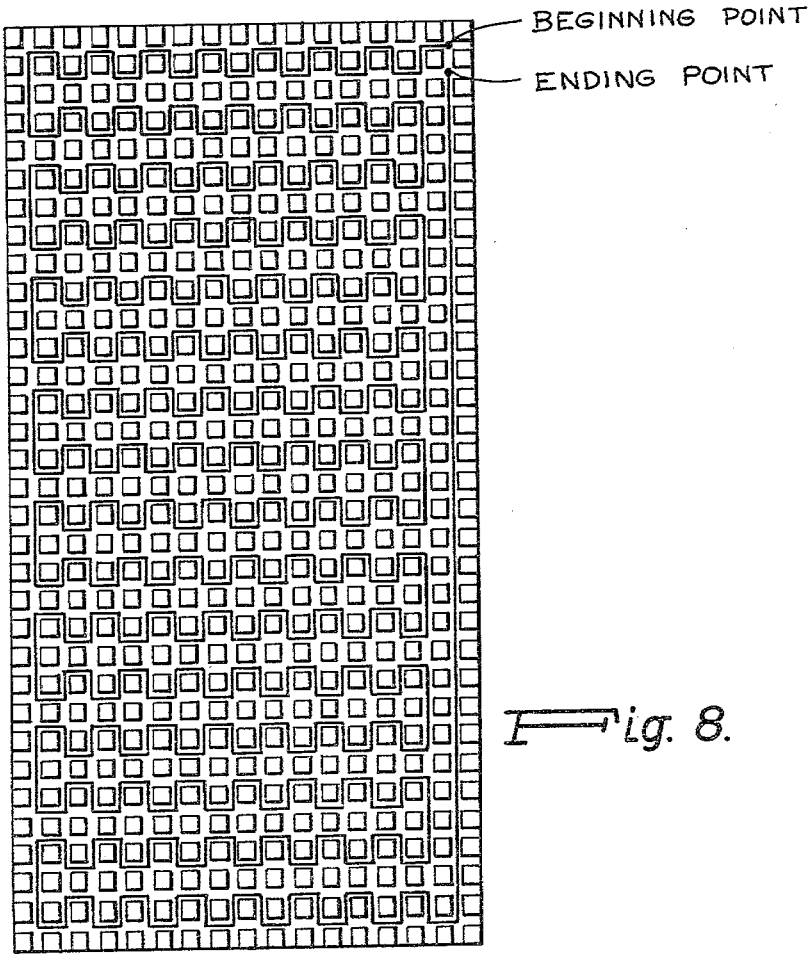
FIG. 8 is a plan view of another embodiment grooved uniformally throughout the whole panel to accommodate a variety of patterns of the electrical heating element and provide uniform flow paths for air heated in the grooves.

It is preferred that the element be laid out in the panel to insure uniform heat flow from all areas of the panel into the adjacent concrete. Clearly, other patterns then shown in FIG. 1 could be provided. For example, a versatile pattern of grooves for containing the resistance heating element either as a single continuous element or as a plurality of elements all connected electrically to each other in parallel, is illustrated by FIG. 8. Here, the whole surface of the base is grooved from edge to edge by uniform rows and columns of grooves. Some of the advantages of providing these uniform fows and columns of grooves are: the grooves are easy to make; and they provide many channels for conducting hot air to covering 31. The added channels carry hot air from the element to all areas of the covering 31 and so the distribution of heat to the covering 31 is uniform.

Another pattern layout of the resistance heating element is also shown in FIGURE 8. Clearly, there ate may possible layouts of the element in this pattern of grooves. It is of some advantage to locate the grooves, and thus, the element, clear of likely nailing points. In the building trade, studs are located spaced at multiples of 12 inches and 16 inches and so these dimensions horizontally across the panel from one edge to the other are preferably clear of the element.

Construction of the panel is completed after installation of the heating element and the controls 11 by applying the covering layer of material 31 on the base surface 1'. The covering material 31 consists of one or more layers of resin impregnated glass fibre that is molded and cured before it is attached to the bases. It is molded with returns at the edges like returns 32 and 33, so that it completely covers the base surface 1' and the edges such as 34 and 35 of the base. Thus, the covering 31 wraps around the edges of the base. This reduces the exposure of the interface between the cover and the base to concrete and abrasive wear and tear when the panels are abutted.

The cover 31 is attached to the base by a suitable adhesive that may be the same resin used to make the cover. The covering 31 is contiguous with the surface 1' and bonded to it and spans the grooves. Thus, it provides the outside surface 31' against which the concrete is poured and which is smooth and even over the whole area of the base. Since the cover spans the grooves, the grooves become tunnels containing the heating element.

As mentioned, the advantages of the form constructed as described herein are that the form is relatively light and easily handled, considering its size; it provides uniform controlled heat flow to the concrete with little loss; and the simple rugged construction is relatively low cost. As mentioned already, the base 1 may be a sheet of heavy plywood. A four by eight foot panel could be constructed of one inch plywood. Furthermore, all of the parts of which the panel is constructed both structural and electrical, are readily available at modest cost and no special tools are needed in the construction.

Other advantages and variations of the construction will be apparent to those skilled in the art and could be substituted for the techniques described herein without deviating from the sphere and scope of the invention as set forth in the appended claims.

What is claimed is:

1. A heated mold panel for casting concrete comprising,
   (a) a panel base providing a rigid supportive base surface defining the panel size and contours,
   (b) a plurality of connecting grooves in the base surface,
   (c) a heating element in the grooves,
   (d) at least one layer of material covering the surface and the grooves in intimate contact with the surface and bonded thereto providing a smooth outer surface substantially parallel to the base surface, and
   (e) heating element controlling means connecting the element to a source of energy,
   (f) whereby the temperature of the element is controlled and heat flows from the element to the concrete poured against the outer surface.
2. A mold panel as in claim 1 wherein,
   (a) the grooves are sufficiently deep that the elements do not protrude across the base surface.
3. A mold panel as in claim 2 wherein,
   (a) the grooves are sufficiently large in cross-section that air flows through the grooves around the element.
4. A mold panel as in claim 1 wherein,
   (a) means are provided on the base for securing the panel in position for pouring concrete against the outer surface.
5. A mold panel as in claim 1 wherein,
   (a) the layer of material is resin impregnated glass fibre.
6. A mold panel as in claim 1 wherein,
   (a) the base has edges, and
   (b) the layer of material at least partially covers said edges.
7. A mold panel as in claim 1 wherein,
   (a) the base is relatively heavy plywood.
8. A mold panel as in claim 1 wherein,
   (a) the grooves define a continuous path from a beginning point to an end point immediately adjacent the beginning point.
9. A mold panel as in claim 8 wherein, (a) the heating element is continuous over said continuous path having one end at the beginning point and the other end at the end point, and (b) means are provided between the beginning and end points for connecting the elements to the source of energy.

10. A mold panel as in claim 9 wherein, (a) means are provided between the beginning and end points for controlling energy to the element in response to the temperature of the concrete.

11. A mold panel as in claim 9 wherein, (a) means are provided for indicating when the element reaches a predetermined temperature to show if the power is on.

12. A mold panel as in claim 10 wherein, (a) the element is electric and the source is electric power.

13. A mold panel as in claim 12 wherein, (a) a temperature sensitive electric switch is provided electrically connected in series with the element.

14. A mold panel as in claim 13 wherein, (a) The switch is normally closed and opens when the temperature of the panel near the outside surface reaches a predetermined temperature.

* * * * *